US011034164B2

(12) United States Patent
Steed et al.

(10) Patent No.: US 11,034,164 B2
(45) Date of Patent: Jun. 15, 2021

(54) PRINTING PATH THAT TRAVELS IN DIFFERENT DIRECTIONS THROUGH DRYER

(71) Applicant: Hewlett-Packard Development Company, L.P., Spring, TX (US)

(72) Inventors: Mike Steed, Corvallis, OR (US); James Kearns, Corvallis, OR (US); Heather L. Stokes, Corvallis, OR (US); Ronald R. Anderson, Corvallis, OR (US); Joe Santich, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 2 days.

(21) Appl. No.: 16/495,316

(22) PCT Filed: Apr. 6, 2017

(86) PCT No.: PCT/US2017/026405
§ 371 (c)(1),
(2) Date: Sep. 18, 2019

(87) PCT Pub. No.: WO2018/186868
PCT Pub. Date: Oct. 11, 2018

(65) Prior Publication Data

US 2020/0016906 A1 Jan. 16, 2020

(51) Int. Cl.
*B41J 11/00* (2006.01)
*B41J 15/04* (2006.01)
(Continued)

(52) U.S. Cl.
CPC ..... *B41J 11/002* (2013.01); *B41J 3/60* (2013.01); *B41J 15/04* (2013.01); *B41M 5/0011* (2013.01)

(58) Field of Classification Search
CPC ..... B41J 11/002; B41J 3/60; B41J 11/0015; B41J 29/38; B41J 15/04; B41J 3/543; B41J 11/007; B41M 5/0011
See application file for complete search history.

(56) References Cited

U.S. PATENT DOCUMENTS 8,205,984 B2 6/2012 Tarnacki
8,465,148 B2 6/2013 Bauer
(Continued)

FOREIGN PATENT DOCUMENTS

DE 102010016856 A1 11/2011
EP 0813971 B1 10/2001

OTHER PUBLICATIONS

Xerox Rialto 900 Inkjet Press, Mar. 14, 2016, Available Online at: < http://www.office.xerox.com/latest/XPISS-01U.pdf >.

*Primary Examiner* — Jannelle M Lebron
(74) *Attorney, Agent, or Firm* — Tong Rea Bentley & Kim LLC

(57) ABSTRACT

In an example, an apparatus is described that includes a first print section, a second print section, a dryer, and a printing path. The first print section includes a first fluid ejection array, while the second print section includes a second fluid ejection array. The dryer is positioned adjacent to the first print section and the second print section. The printing path that travels in a first direction through the dryer after exiting the first print section and travels in a second direction through the dryer after exiting the second print section.

14 Claims, 3 Drawing Sheets

(51) Int. Cl.
*B41M 5/00* (2006.01)
*B41J 3/60* (2006.01)

(56) References Cited

U.S. PATENT DOCUMENTS

2011/0316910 A1 12/2011 Azuma
2014/0354728 A1* 12/2014 Murata ..... B41J 11/002
347/16

* cited by examiner

PRINTING PATH THAT TRAVELS IN DIFFERENT DIRECTIONS THROUGH DRYER

BACKGROUND

Digital printing technologies rely on the adhesion of printing fluid particles to a print target (e.g., a web of material or a build bed) to produce a printed item. The location of the printing fluid particles on the print target, and in some cases the phase change of the printing fluid particles, is electrically controlled to produce a desired image. Some digital printing technologies include mechanisms for adhering printing fluid particles to both sides of a print target.

DETAILED DESCRIPTION

The present disclosure broadly describes an apparatus, method, and non-transitory computer-readable medium for printing on a print target using a printing path that travels in at least two different directions through a dryer. As discussed above, some digital printing devices include two print sections that are positioned to allow for printing on both sides of a print target (which in some cases may comprise a continuous web). Printing on both sides of the print target may introduce challenges in terms of drying. For instance, it is difficult to maintain a compact size for the printing device as a whole while providing both print sections with access to a dryer that is large enough to fully dry the printing fluid.

Examples of the present disclosure provide a printing device and method for printing on one or both sides of a continuous web of print target. Examples of the printing device include two print sections (one for each side of the print target) that share the same dryer for drying fluid. The printing path that the print target travels through the print sections and dryer takes a serpentine shape having at least two switchbacks (e.g., changes in direction). In some examples, there may be as many as four switchbacks, or even more than four switchbacks. The switchbacks cause the printing path to travel in opposite directions when it moves through the dryer for the first and second times. This arrangement allows two similar print sections to print, and a shared dryer to dry, both sides of a continuous web of print target, without flipping the print target during printing and/or drying. This compact configuration will allow the printing device to maintain smaller overall dimensions, which will make it easier to fit the printing device into shipping containers and some customer premises. It also allows two or more different types of dryers to be used to dry the print target at different points in the drying process, and even for dryers to be added after deployment of the printing device.

Figure 1:
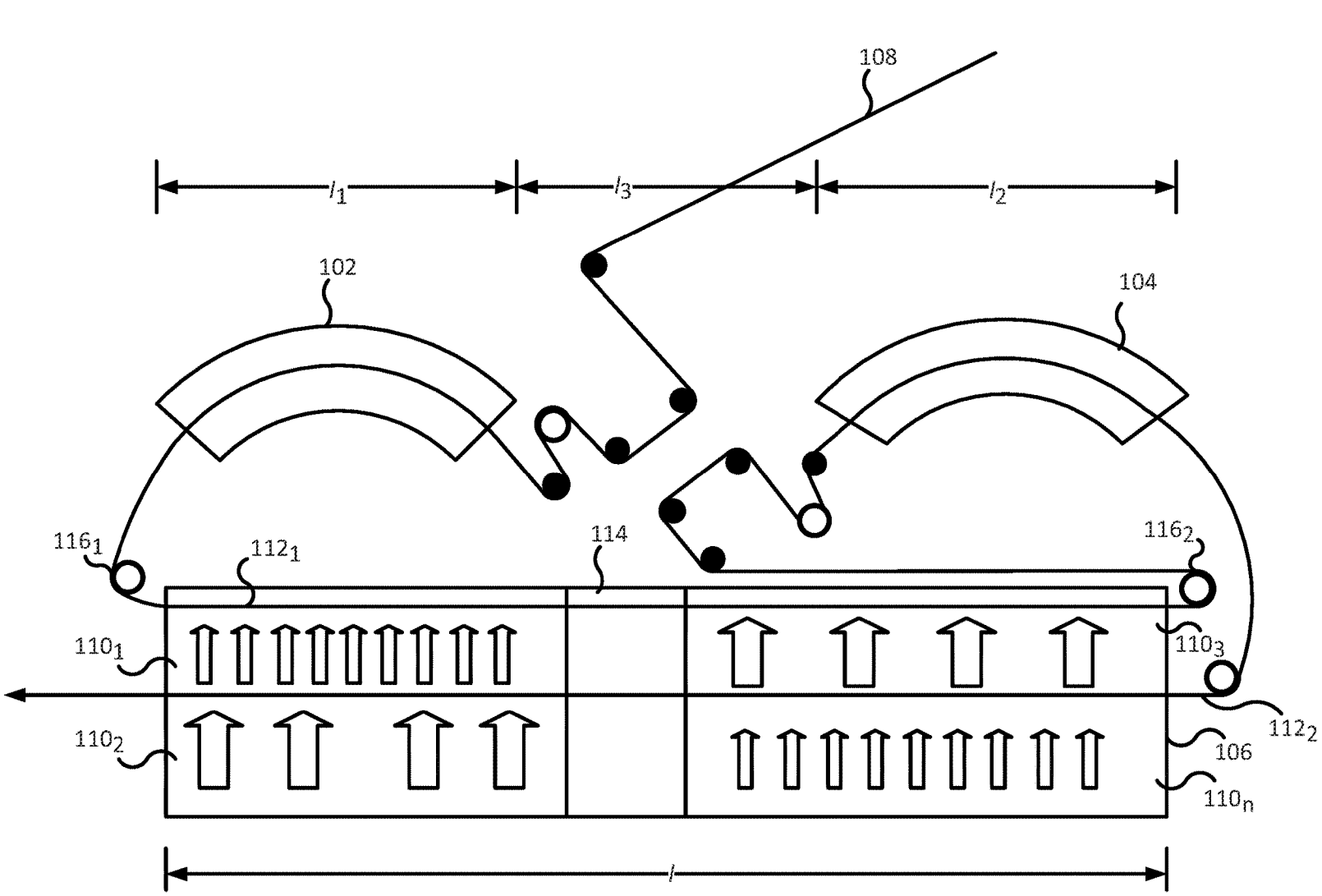
FIG. 1 is a block diagram of an example system of the present disclosure.

FIG. 1 illustrates an example system 100 of the present disclosure. In one example, the system 100 comprises a digital printing device, such as an inkjet or drop-on-demand printing device, that prints on a continuous web of print target. In one example, the system 100 generally includes a first print section 102, a second print section 104, and a dryer 106. A printing path 108 carries the print target through the device 100, including through the first print section 102, the second print section 104, and the dryer 106. Any of these components may be controlled by a high-level controller (not shown), potentially in combination with a lower-level controller. The high-level controller may be implemented in a computer, as discussed in connection with FIG. 3. The system 100 includes other components as well (e.g., upstream and downstream components, such as unwinders, rewinders, or finishing devices that cut, stack, perforate, fold, glue and perform other operations to the system output, and other components) that are not directly pertinent to the present disclosure and are thus omitted for clarity. Thus, FIG. 1 represents a simplified illustration of the system 100.

Each of the first print section 102 and the second print section 104 is configured to dispense fluid (e.g., printing fluid, toner, detailing agent, or the like) onto one side of the print target, such that the fluid recreates an input image. In particular, the first print section 102 is configured to dispense fluid onto a first side of the print target to recreate a first image, while the second print section 104 is configured to dispense fluid onto a second side of the print target (opposite the first side of the print target) to recreate a second image. To this end, each of the first print section 102 and the second print section 104 may comprise a plurality of fluid ejection arrays (e.g., print bars), where each fluid ejection array further comprises a plurality of fluid ejection dies (e.g., print heads) that eject fluid in one or more colors. For instance, each of the first print section 102 and the second print section 104 may comprise four, six, ten, or any other number of fluid ejection arrays. The printing path 108 is configured to present the first side of the print target to the first print section 102 and the second side of the print target to the second print section 104. Thus, although the first print section 102 and the second print section 104 may be configured in a substantially similar manner and orientation (e.g., the same components arranged in the same manner), the printing path 108 is configured such that the first and second sides of the web are presented to the first print section 102 and the second print section 104, respectively, in the correct orientation for printing.

In one example, the first print section 102 and the second print section 104 are positioned side-by-side, as illustrated in FIG. 1. That is, the first print section 102 and the second print section 104 are spaced apart from each other laterally. In one example, the first print section 102 and the second print section 104 are configured similarly and mirrored across the lateral separation. The dryer 106 is positioned adjacent to (e.g., below) the first print section 102 and the second print section 104. In one example, the length, l, of the dryer 106 is approximately equal to (e.g., equal within a few inches' tolerance of) $l_1+l_2+l_3$, where $l_1$ is the length of the first print section 102, $l_2$ is the length of the second print section 104, and $l_3$ is the length of a lateral separation or space between the first print section 102 and the second print section 104.

The dryer 106 may comprise one or more drying units $\mathbf{110}_1$-$\mathbf{110}_n$ (hereinafter collectively referred to as "drying units 110"). In one example, the drying units 110 are arranged along the length l of the dryer 106, and may be stacked. In one example, the drying units 110 comprise two or more different types of drying units (e.g., based on two or more different types of drying mechanisms, such as infrared light, light emitting diode, radio frequency, forced hot air, or the like). The arrows illustrated within the drying units 110 represent one or more means for adding energy to (e.g., drying) the print target. The drying units 110 may be relatively "dumb," i.e., configured in one way per print job. Alternatively, the drying units 110 may be more sophisticated, and may adapt constantly to the print job as it is printing and drying. A passive (e.g., no energy is being added) section 114 may be defined between at least two of the drying units 110. This passive section 114 may be used to recirculate some of the hot air generated by the dryer 106. For example, hot air generated from a first pass of the print target through the dryer 106 could be recycled and used to preheat the dryer 106 for a second pass of the print target through the dryer.

The dryer 106 includes at least two drying lanes $\mathbf{112}_1$ and $\mathbf{112}_2$ (hereinafter collectively referred to as "drying lanes 112") that are traversed by the printing path 108. A first drying lane $\mathbf{112}_1$ moves in a first direction (e.g., from the first print section 102 toward the second print section 104), while a second drying lane $\mathbf{112}_2$ moves in the opposite direction (i.e., approximately 180 degrees from the first direction, for example from the second print section 104 toward the first print section 102). Each of the drying lanes 112 exposes the print target on the printing path 108 to one or more of the drying units 110. The first drying lane $\mathbf{112}_1$ and the second drying lane $\mathbf{112}_2$ may be orientated substantially parallel to each other (e.g., parallel within a few degrees' tolerance), and each of the first drying lane $\mathbf{112}_1$ and the second drying lane $\mathbf{112}_1$ may be orientated in a substantially perpendicular manner relative to the passive section(s) 114 of the dryer 106.

As illustrated, the printing path 108 that the print target travels through the first and second print sections 102 and 104 and the dryer 106 takes a serpentine shape having multiple switchbacks (two of which, i.e., $\mathbf{116}_1$ and $\mathbf{116}_2$ are labeled in FIG. 1). The printing path 108 carries the print target in a first direction from the unwinder of the system 100 (not shown) into the first print section 102, which deposits fluid (e.g., printing fluid, toner, detailing agent, or the like) on a first side of the print target. Upon exiting the first print section 102, the printing path 108 reverses direction and carries the print target through the dryer 106 for a first time (i.e., along the first drying lane $\mathbf{112}_1$), thereby drying the fluid on the first side of the print target. Upon exiting the dryer 106 for the first time, the printing path 108 reverses direction again and carries the print target through the second print section 104, which may deposit fluid on the second side of the print target (if dual-sided printing is desired). Upon exiting the second print section 104, the printing path 108 carries the print target through the dryer 106 for a second time (i.e., along the second drying lane $\mathbf{112}_2$), thereby drying any fluid on the second side of the print target. The printing path 108 may reverse direction at least once after exiting the second print section 104 and prior to entering the dryer 106 for the second time, such that the printing path 108 travels in opposite directions the first and second times it moves through the dryer 106 (i.e., using the first and second printing lanes $\mathbf{112}_1$ and $\mathbf{112}_2$ to carry the print target in opposite directions). Upon exiting the dryer 106 for the second time, the printing path 108 may travel toward a vision system (not shown) of the system 100 which provides feedback to the system 100.

Figure 2:
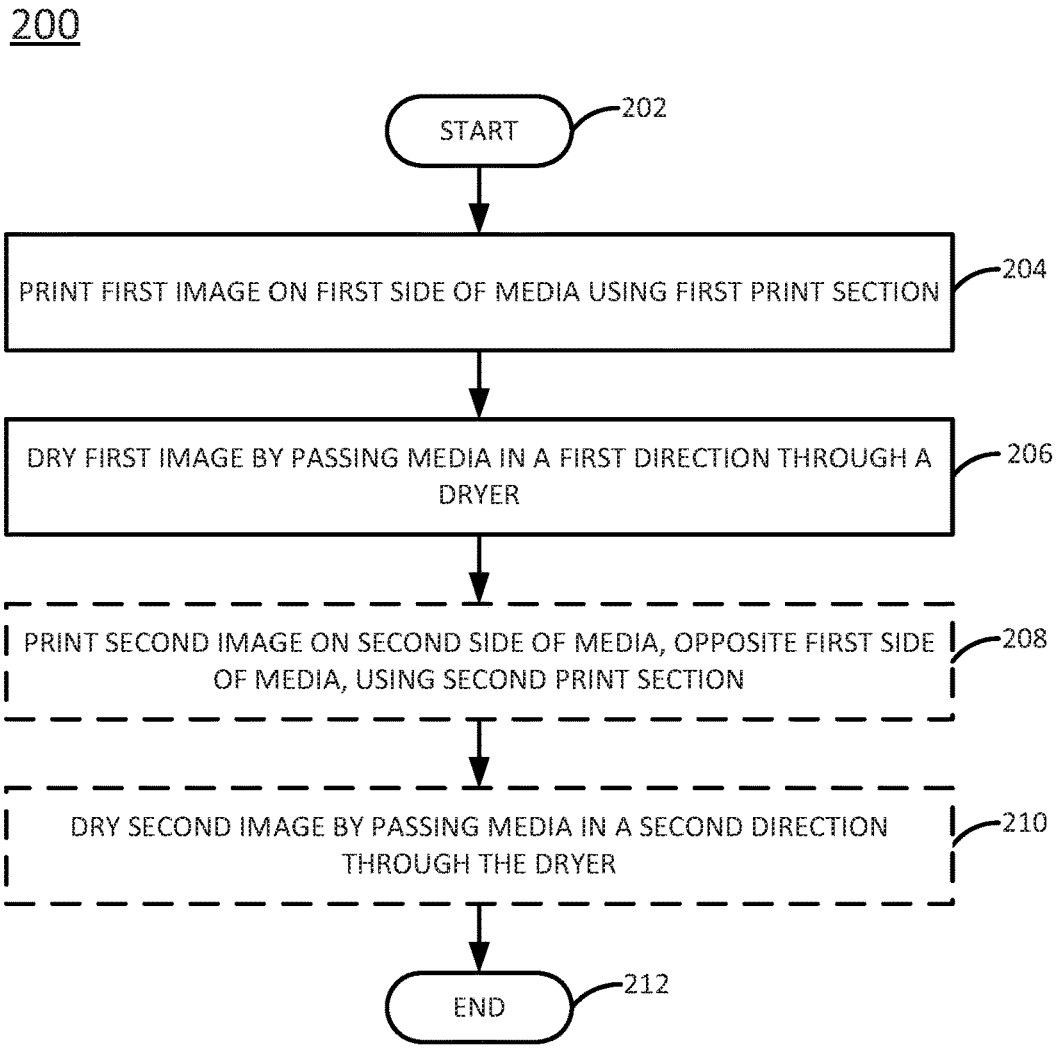
FIG. 2 illustrates a flowchart of an example method for printing on a print target.

FIG. 2 illustrates a flowchart of an example method 200 for printing on a print target. The method 200 includes blocks for printing and drying at least one side of a print target, as discussed above in connection with FIG. 1. The method 200 may be performed, for example, by the system 100 illustrated in FIG. 1. It will be appreciated, however, that the method 200 is not limited to implementation with the system illustrated in FIG. 1.

The method 200 begins in block 202. In block 204, the system 100 prints an image on a first side of a print target. The print target may be a continuous web of print target, as discussed above. In one example, the system 100 uses the first print section 102 to print the image on the first side of the print target. Thus, the paper path 108 may carry the print target from an unwinder of the system 100 and into the first print section in block 204.

In block 206, the system 100 dries the image printed on the first side of the print target. In one example, the paper path 108 may reverse direction to carry the print target from the first print section 104 and into the dryer 106. Thus, the paper path 108 travels in a first direction for a first pass through the dryer 106 in block 206.

In block 208 (illustrated in phantom), the system 100 may print an image on a second side of the print target that is opposite the first side of the print target. In one example, the system 100 uses the second print section 104 to print the image on the second side of the print target. Thus, the paper path 108 may reverse direction at least once to carry the print target from the dryer 106 and into the second print section in block 208. In one example, the system 100 prints on the first side of the print target and subsequently prints on the second side of the print target without turning the print target over in between printing operations.

In block 210 (illustrated in phantom), the system 100 may dry the image printed on the second side of the print target. In one example, the paper path 108 may reverse direction to carry the print target from the second print section 104 and into the dryer 106. Thus, the paper path 108 travels in a second direction for a second pass through the dryer 106 in block 210. In one example, the second direction in which the paper path 108 travels for the second pass through the dryer 106 (e.g., in block 210) is the opposite (e.g., different by approximately 180 degrees) of the first direction that the paper path 108 travels for the first pass through the dryer 106 (e.g., in block 206). In one example, the system 100 dries the first side of the print target and subsequently dries the second side of the print target without turning the print target over in between drying operations.

The method 200 ends in block 212. After all sides of the print target that have been printed on have been dried, the system 100 may deliver the print target to a vision system of the system 100. The paper path 108 may or may not reverse direction to carry the print target from the dryer 106 to the vision system.

Figure 3:
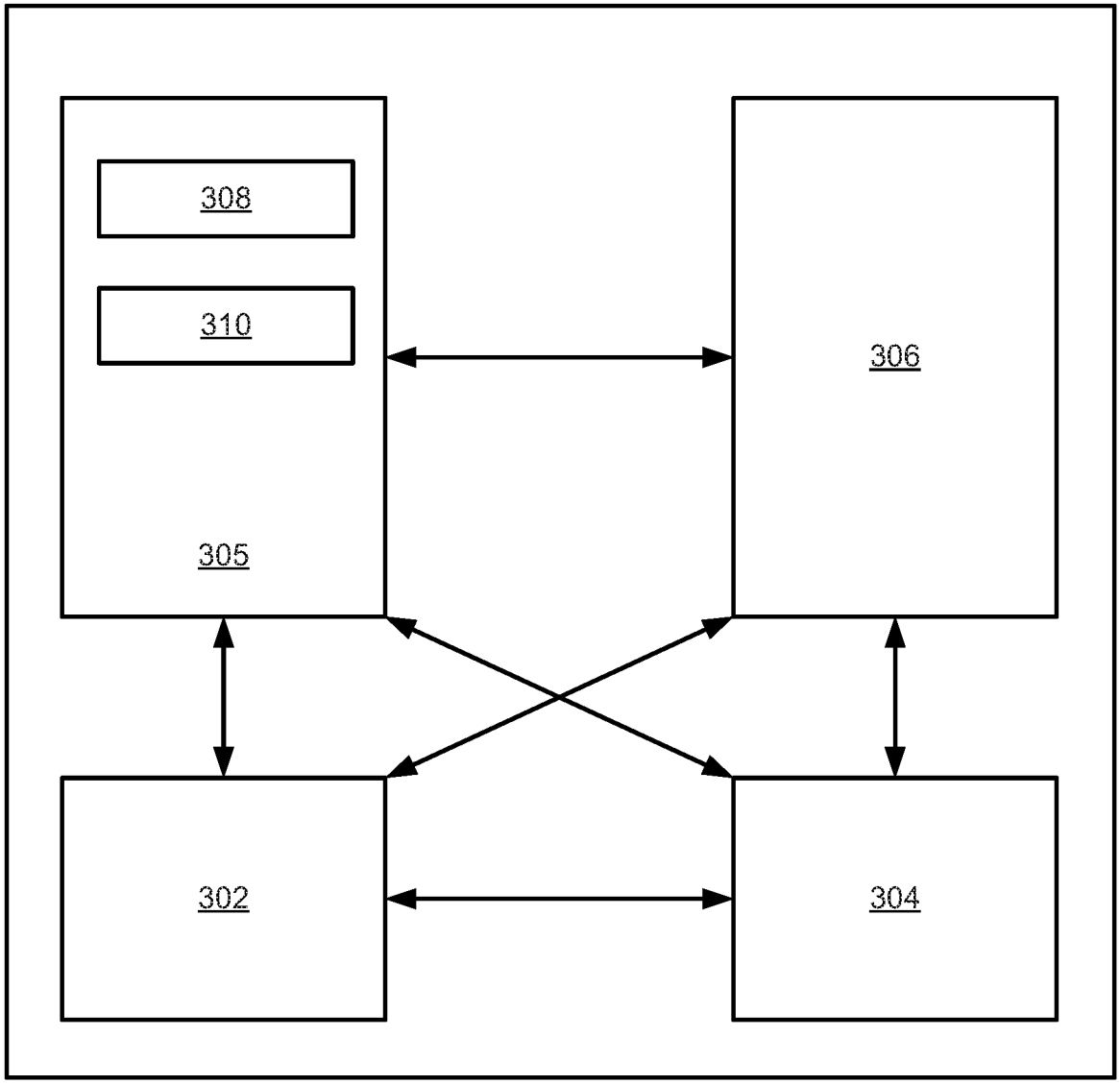
FIG. 3 depicts a high-level block diagram of an example computer that can be transformed into a machine capable of performing the functions described herein.

FIG. 3 depicts a high-level block diagram of an example computer that can be transformed into a machine capable of performing the functions described herein. Examples of the present disclosure modify the operation and functioning of the general-purpose computer to print on one or both sides of a web of print target, as disclosed herein.

As depicted in FIG. 3, the computer 300 comprises a hardware processor element 302, e.g., a central processing unit (CPU), a microprocessor, or a multi-core processor, a memory 304, e.g., random access memory (RAM) and/or read only memory (ROM), a module 305 for printing on one or both sides of a web of print target, and various input/output devices 306, e.g., storage devices, including but not limited to, a tape drive, a floppy drive, a hard disk drive or a compact disk drive, a flash drive, a receiver, a transmitter, a speaker, a display, a speech synthesizer, a fiber optic communication line, an output port, an input port and a user input device, such as a keyboard, a keypad, a mouse, a microphone, and the like. Although one processor element is shown, it should be noted that the general-purpose computer may employ a plurality of processor elements. Furthermore, although one general-purpose computer is shown in the figure, if the method(s) as discussed above is implemented in a distributed or parallel manner for a particular illustrative example, i.e., the blocks of the above method(s) or the entire method(s) are implemented across multiple or parallel general-purpose computers, then the general-purpose computer of this figure is intended to represent each of those multiple general-purpose computers. Furthermore, a hardware processor can be utilized in supporting a virtualized or shared computing environment. The virtualized computing environment may support a virtual machine representing computers, servers, or other computing devices. In such virtualized virtual machines, hardware components such as hardware processors and computer-readable storage devices may be virtualized or logically represented.

It should be noted that the present disclosure can be implemented by machine readable instructions and/or in a combination of machine readable instructions and hardware, e.g., using application specific integrated circuits (ASIC), a programmable logic array (PLA), including a field-programmable gate array (FPGA), or a state machine deployed on a hardware device, a general purpose computer or any other hardware equivalents, e.g., computer readable instructions pertaining to the method(s) discussed above can be used to configure a hardware processor to perform the blocks, functions and/or operations of the above disclosed method (s).

In one example, instructions and data for the present module or process 305 for printing on one or both sides of a web of print target, e.g., machine readable instructions can be loaded into memory 304 and executed by hardware processor element 302 to implement the blocks, functions or operations as discussed above in connection with the method 200. For instance, the module 305 may include a plurality of programming code components, including a printing component 308 and a drying component 310. These programming code components may be included, for example, on a controller that controls a printing device configured in a manner similar to the system 100.

The printing component 308 may be configured to identify on which sides of a print target to print (e.g., one side or both sides) and to activate the appropriate print sections of a system to print an image by dispensing fluid as the print target passes through the print sections. For instance, the printing component 308 may control at least some of the functions discussed above with respect to blocks 204 and 208 of the method 200.

The drying component 310 may be configured to identify when particular drying units of a dryer should be activated, and to activate the drying units accordingly. For instance, depending on whether one or both sides of a print target are being printed upon, different drying units may be activated at different times. Thus, the drying component 310 may control at least some of the functions discussed above with respect to blocks 206 and 210 of the method 200.

Furthermore, when a hardware processor executes instructions to perform "operations", this could include the hardware processor performing the operations directly and/or facilitating, directing, or cooperating with another hardware device or component, e.g., a co-processor and the like, to perform the operations.

The processor executing the machine readable instructions relating to the above described method(s) can be perceived as a programmed processor or a specialized processor. As such, the present module 305 for printing on one or both sides of a web of print target, including associated data structures, of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, or variations therein may be subsequently made which are also intended to be encompassed by the following claims.

What is claimed is:

1. An apparatus, comprising:

a first print section comprising a first fluid ejection array;

a second print section comprising a second fluid ejection array;

a dryer positioned adjacent to the first print section and the second print section;

a printing path that travels in a first direction through the dryer after exiting the first print section and travels in a second direction through the dryer after exiting the second print section;

wherein the dryer comprises:

a first drying lane that is traversed by the printing path in the first direction; and a second drying lane that is traversed by the printing path in the second direction.

2. The apparatus of claim 1, wherein the printing path is configured to present a first side of a print target to the first print section and a second side of the print target to the second print section.

3. The apparatus of claim 1, wherein the first print section and the second print section are positioned side-by-side and spaced apart by a lateral separation.

4. The apparatus of claim 3, wherein a length of the dryer is approximately equal to a length of the first print section plus a length of the second print section plus a length of the lateral separation.

5. The apparatus of claim 1, wherein the dryer comprises a plurality of drying units.

6. The apparatus of claim 5, wherein the dryer further comprises a passive section between at least two drying units of the plurality of drying units.

7. The apparatus of claim 5, wherein the plurality of drying units comprises at least two different types of drying units.

8. The apparatus of claim 1, wherein the first drying lane and the second drying are orientated substantially parallel to each other.

9. The apparatus of claim 1, wherein the first direction is opposite the second direction.

10. The apparatus of claim 1, wherein the apparatus is an inkjet printing device.

11. A method, comprising:

printing a first image on a first side of a print target using a first print section of a system;

drying the first image on the first side of the print target by passing the print target in a first direction through a first drying lane of a dryer of the system;

printing a second image on a second side of the print target, opposite the first side of the print target, using a second print section of the system; and drying the second image on the second side of the print target by passing the print target in a second direction through a second drying lane of the dryer of the system.

12. The method of claim 11, wherein the first direction is different from the second direction.

13. A non-transitory machine-readable storage medium encoded with instructions executable by a processor, the machine-readable storage medium comprising:

instructions to print a first image on a first side of a print target using a first print section of a system;

instructions to dry the first image on the first side of the print target by passing the print target in a first direction through a first drying lane of a dryer of the system;

instructions to print a second image on a second side of the print target, opposite the first side of the print target, using a second print section of the system; and instructions to dry the second image on the second side of the print target by passing the print target in a second direction through a second drying lane of the dryer of the system.

14. The non-transitory machine-readable storage medium of claim 13, wherein the first direction is different from the second direction.

* * * * *